United States Patent [19]

Lalezari et al.

[11] Patent Number: 4,931,808

[45] Date of Patent: Jun. 5, 1990

[54] EMBEDDED SURFACE WAVE ANTENNA

[75] Inventors: Farzin Lalezari, Louisville; Michael G. Munson; Theresa A. Cronin, both of Boulder, all of Colo.

[73] Assignee: Ball Corporation, Muncie, Ind.

[21] Appl. No.: 295,423

[22] Filed: Jan. 10, 1989

[51] Int. Cl.[5] ..... H01Q 19/06; H01Q 13/24

[52] U.S. Cl. ..... 343/753; 343/785

[58] Field of Search ..... 343/705, 753, 785, 787, 343/783, 795, 799

[56] References Cited

U.S. PATENT DOCUMENTS

| | | | |
|---|---|---|---|
| 2,822,542 | 2/1958 | Butterfield | 343/785 |
| 3,099,836 | 7/1963 | Carr | 343/753 |
| 3,868,694 | 2/1975 | Meinke | 343/758 |
| 4,087,822 | 5/1978 | Maybell et al. | 343/783 |
| 4,835,543 | 5/1989 | Sequeira | 343/785 |

*Primary Examiner*—Rolf Hille
*Assistant Examiner*—Doris J. Johnson
*Attorney, Agent, or Firm*—Gilbert E. Alberding

[57] ABSTRACT

An embedded surface wave antenna is described of compact design capable of broadband performance both for impedance match and for radiation pattern characteristics comprising two spaced apart conductive planar elements, one element being a transition from a narrow portion to a wider portion according to a continuous function, said one element having an upward inclination away from the other of said conductive planar elements and ending in a termination at the wider portion, a tapered lens material having a downward inclination from said termination toward said other of said conductive planar elements to define a sloping surface therebetween for launching and receiving electromagnetic waves. The subject surface wave antenna may be readily adapted into assemblies of radiating elements in a predetermined electrical and geometric configuration to provide an array rendering a preferred radiation pattern.

51 Claims, 5 Drawing Sheets

EMBEDDED SURFACE WAVE ANTENNA

BACKGROUND OF THE INVENTION

This invention relates to an antenna structure, and, more particularly, a novel conformal aerodynamic antenna structure having broadband characteristics as well as a radiation pattern and impedance characteristics that are essentially independent of frequency over a wide range.

In designing antenna structures, it should be kept in mind that the antenna designer must make the antenna perform a desired electrical function such as transmitting/receiving linearly polarized, righthand circularly polarized, left-hand circuitry polarized, etc., r.f. signals with appropriate gain, bandwidth, beamwidth, minor lobe level, radiation efficiency, aperture efficiency, receiving cross section, radiation resistance and other electrical characteristics. It is also necessary for these structures to be lightweight, simple in design, inexpensive and unobtrusive since an antenna is often required to be mounted upon or secured to a supporting structure or vehicle such as high velocity aircraft, missiles, and rockets which cannot tolerate excessive deviations from aerodynamic shapes. Of course, it is also sometimes desirable to hide the antenna structure so that its presence is not readily apparent for aesthetic and/or security purposes. Accordingly, the ideal electrical antenna should physically be small in volume and not protrude on the external side of a mounting surface, such as an aircraft skin or the like, while yet still exhibiting all the requisite electrical characteristics.

In designing antenna structures, the environment in which they are to effectively operate must be kept in mind. For example, when such antenna structures are placed on aircraft and/or missiles, they must exhibit mechanical characteristics to enable them to withstand extreme thermal environments without degradation in electrical performance. In this regard, previous approaches have been to use high temperature material as an antenna radome and attempt to tune such antenna structures after installation. As a result, this procedure does not fully lend itself to inexpensive high volume production due to the level of skill which is required in properly tuning such antenna structures.

Antennas that have very low profiles which may be flush mounted on supporting surfaces are generally referred to as conformal antennas. As discussed, these antennas must actually conform to the contour of the supporting surface, and, therefore, reduce or eliminate any turbulent effects that would result when such devices are mounted or secured to a vehicle and propelled through space. Conformal antennas may, of course, be constructed by several methods, but can be generally produced by rather simple photoetching techniques since such techniques offer ease of fabrication at a relatively low production cost.

Such conformal antennas or printed circuit board antennas, as they may be called, are formed by etching a single side of a unitary metallically clad dielectric sheet or electrodeposited film using conventional photoresist-etching techniques. Typically, the entire thickness of antenna structure may possibly be at some fraction of a wavelength and be made to minimize cost and maximize manufacturing and/or operating reliability and reproducibility. It can be appreciated that fabrication cost may be substantially minimized since single antenna elements and/or arrays of such elements together with appropriate r.f. feedlines, phase shifting circuits and/or impedance matching networks may all be manufactured as integrally formed electrical circuits along using low cost photoresist-etching processes commonly used to make electronic printed circuit boards. This is to be compared with many complicated and costly prior art techniques for achieving polarized radiation patterns with internal but separate component fabrication as, for instance, a turnstile dipole array, the cavity backed turnstile slot array and other types of special antennas.

A resonant antenna is one which is an integral number of half-wavelengths. In a resonant antenna standing waves of current and voltage are established causing the maximum amount of radiated energy to be radiated as the antenna reactance for a particular frequency is lowest. A common example of a resonant antenna is the long open-ended linear antenna in which there is a sinusoidal current distribution having two waves of equal amplitude and 180° phase difference at the open-end traveling in opposite directions along its length. The voltage distribution has also a standing wave pattern except that it has maxima at the end of the line instead of nulls as the current. For such distributions, the maxima and minima repeat every integral number of half-wavelengths. In such a distribution there is a one-quarter spacing between a null and maximum in each pattern. Thus, a resonant antenna may be referred to as a standing wave antenna.

Of course, an antenna need not exhibit resonant properties to operate satisfactorily. An antenna may operate and be designed to have approximate uniform current and voltage amplitudes along its length. Such an antenna is generally characterized as a traveling wave antenna and is nonresonant. This may be accomplished by properly terminating the antenna structure so that reflections are substantially reduced. Usually a progressive phase pattern is associated with the current and voltage distribution for such traveling wave or nonresonant antennas. Polyrod, helix, long wires, Yagi-Uda, log-periodic and slots and holes in a waveguide as well as numerous aperture antennas including reflectors and horns are typical illustrations of discrete-element traveling wave antennas.

In general, an antenna is limited in the range of frequencies over which it effectively operates. An antenna may operate satisfactory, of course, within a fixed frequency range with a signal that is yet narrower in its bandwidth and, generally, in the design of such an antenna there are no particular bandwidth problems. On the other hand, if a broadband antenna is required, there are often a number of difficulties that an antenna designer must overcome to produce a satisfactory operating antenna device. Under certain conditions, it is possible in a number of applications to actually use an essentially narrow-band antenna over a wide frequency range if allowance and provisions are actually made for modifying the antenna's dimensional characteristics or for adjusting the impedance matching transformer characteristics of the antenna. In many operations, however, it is necessary that an antenna structure having a fixed configuration operate over a very broad range of frequencies. Accordingly, a number of broadbanding techniques have been practiced to achieve this operating condition since an antenna having a broad bandwidth is highly desirable.

In considering bandwidth, there are generally two categories of parameters to be addressed: (1) the antenna radiation pattern, and (2) impedance characteristics. As regards the radiation pattern, parameters to be considered for designing a broadband antenna include the power gain, beamwidth, side-lobe level, beam direction and polarization and, as regards the impedance characteristics, parameters to be considered include input impedance, radiation resistance and antenna efficiency.

With respect to a resonant antenna, resistive loading of such an antenna provides a means to broaden its impedance bandwidth. In this regard, broadband dipole antennas have been made by making the thickness of the conducting element large relative to their length. Thus, broadbanding dipole structures have been simply accomplished by employing large diameter conductors rather than thinner ones. In this regard, biconical antennas belong to this general class and are generally considered to be broadband antennas. Nonetheless, resistive loading is not generally employed for antennas operating at high frequencies since conductor losses are usually exceeding small which, in turn, results in an antenna having an inadequate bandwidth.

Certain antennas having a wide variety of physical sizes and shapes are known to be frequency independent, often achieving bandwidths of at least 10 to 1 and substantially higher. In general, their broadband behavior includes both impedance and radiation pattern characteristics. Such frequency independent antennas, as they are called, generally exhibit a certain shape or pattern of geometric form. For such antennas there are certain structural patterns that are more or less repeated with changing dimensions. An illustrative example of this design characteristic is found in the so-called log-periodic dipole array antenna.

Although a number of such antennas are known and include the Beverage antenna, spiral antennas, rhombic antennas, the biconical and the aforementioned log-periodic antennas, all these devices are relatively large and require substantial space. Further, such antennas do not lend themselves to flush or low-silhouette installation.

The subject invention relates to an easy to fabricate conformally mounted antenna that offers a number of outstanding advantages over the prior art. Moreover, although certain related patents may at first blush appear to be closely related to the subject invention, closer inspection reveal significant differences. In this regard, U.S. Pat. No. 3,868,694 to Meinke relates to a dielectric directional antenna that uses a wedge shaped dielectric with conducting exciters on each side of the angular sides. In one embodiment of Meinke, one of the exciters can be triangular and the other a ground plane with a coaxial line feeding the exciters. U.S. Pat. No. 3,099,836 to Carr discloses a V-strip antenna with an artificial dielectric lens in which the strips may have a parabolic curvature. In the Carr antenna, the bandwidth is extended to higher frequencies operable over a frequency range of greater than 10 to 1 by the use of metal elements concentrated and arranged between the inside surfaces of his antenna. Further, U.S. Pat. No. 2,822,542 to Butterfield discloses a directive antenna device in which a waveguide may be coupled to a dielectric radiating member having a wedge shaped configuration. It should be noted that in the antenna as disclosed by Butterfield, the bandwidth of his antenna would be limited by the cutoff frequency of the waveguide feed.

In the prior art, flush mounted channel guide antennas are known as a surface wave structures consisting of a solid dielectric waveguide of rectangular cross section embedded in a metallic channel with one end of the dielectric and channel tapered to launch the radiation efficiently at the end of the dielectric. The other end of the channel may be connected to the r.f. source by various means to launch a surface wave in the channel. Typically, the launcher might be an open end waveguide, horn, or wire launcher.

Although the aforementioned representative patents have certain characteristics in common with the subject invention, they do not demonstrate the advantageous structural characteristics and associated broadband properties as disclosed and claimed herein.

BRIEF SUMMARY OF THE INVENTION

It is the object of this invention to provide an improved broadband conformal antenna element having simplicity of design and ease of fabrication.

It is another object of the invention to provide an improved high gain radiating element of novel configuration that is frequency independent, especially over the high frequency range, and that can be used as a directive antenna either alone or in an array.

It is yet another object of the subject invention to provide a novel endfire, traveling wave antenna device of compact design and relatively small in volume that can be readily flush mounted.

It is another object of this invention to provide a conformal, aerodynamic antenna having compactness and symmetrical design which is capable of broadband performance both for impedance match and for radiation pattern characteristics.

It is another object of the instant invention to provide a broadband array adapted to operate in one or two of a number of polarizations.

It is yet another object of this invention to provide an embedded antenna that can be easily produced as a tuned device on an inexpensive high volume production basis.

It is another object of this invention to provide a broadband antenna which lends itself to high temperature and pressure applications as well as having applications useful for low observable platforms and the like.

These and other objects of the invention are attained by providing an antenna structure for receiving and transmitting electromagnetic waves comprising a conductive means including two spaced apart planar legs, one conductive leg having a transition from a narrow portion to a wide portion according to a continuous function, said conductive legs spreading outwardly and ending in respective terminations, and a lens material coupled to and filling the space between said conductive legs, said material having a maximum thickness at a first termination and tapering downwardly therefrom toward the second termination to define an aperture therebetween.

The subject invention provides an embedded antenna structure having broadband characteristics comprising two spaced apart conductive planar members, one member being a transition from a narrow portion to a wider portion according to a continuous function, said one member having an upward inclination away from the other of said conductive planar members and ending in a termination at the wider portion, a tapered lens material having a downward inclination from said termination toward said other of said conductive planar members to define a sloping surface therebetween for launching and receiving electromagnetic waves.

It is understood that the term or expression planar, planar legs, planar arrangement and the like as herein disclosed and claimed include those structures and situations that are curved, sloped or other distortions from the more purely planar geometry or flat configuration.

From another aspect, the subject invention relates to a traveling wave antenna comprising a wedge-shaped electromagnetic window having a narrow side with a single edge and a broader side with an upper edge and a lower edge, a first conducting element coupled to the upper edge, a second conducting element disposed across the lower edge and extending toward said single edge, said first and second conducting elements being spaced apart and having a planar configuration, said first conducting element having a trumpet-like configuration and tapering upwardly towards said upper edge from a point adjacent said second conducting element and separated therefrom by a gap.

A particularly advantageous arrangement is achieved for receiving and launching electromagnetic waves, particularly in the form of a collimated beam, comprising a conductive means comprising two spaced-apart planar surfaces, one inductive surface having a transition from a narrow portion to a wide portion according to a junction, said conductive surface spreading outwardly and ending into a first termination and a second termination, respectively, and an electromagnetic lens material coupled to and filling the space between said conductive surfaces, said material having a maximum thickness at the first termination and a thinner thickness at the second termination. The two spaced-apart planar surfaces may be completely different in area or mere duplications of the same structure. In this latter respect, they may be self-complementary and exhibit mirror-like images of one another or enantiomorphic in their configurations.

The two conducting elements are integral with the electromagnetic window and take the form of metallizations that are generally situated on or bound to a tapered substrate, such as a dielectric material, and are spaced one from the other. The two metallizations lie on separate intersecting faces of a tapered substrate and are arranged to one another so that a gap portion is formed in which the metallizations are closely spaced to one another at a relatively narrow portion of the tapered substrate and a mouth portion is formed at a wider portion of the tapered substrate. Each metallization may take on a particular configuration, as in a preferred embodiment, an alphorn or trumpet-like configuration. These configurations may, in yet another embodiment, be complimentary, i.e., be duplicated on the adjoining face of the substrate. The second conducting element may be considered a reference plane and may be flat or curved. It will be appreciated from the disclosure herein that the two conducting elements act as a modified microstrip transmission line that support a TEM mode. In a preferred embodiment the first conducting element curves exponentially outwardly from a gap portion according to a continuous function, either a linear or parabolic function.

A traveling wave antenna implies a continuous radiating source that is structured long in terms of wavelength. Any radiating structure that, from a normal visual level, appears to have no discontinuities or interruptions except at the portions or ends of the radiating structure may be considered to be a continuous source. In effect, a traveling wave antenna is one in which the fields and currents that produce the antenna field pattern may be represented by one or more traveling waves, usually in the same direction.

There are generally two types of traveling wave antennas. A traveling wave with an angular frequency w and a phase constant $\beta$ has a phase velocity $v=w/\beta$ and such a wave may be classified as either fast or slow wave depending on whether v is greater than or less than the velocity c of a plane wave in free space. Hence, a wave having $c/v \leqq 1$ is referred to as a fast wave and a wave having $c/v \geqq 1$ is referred to as a slow wave. Thus, the first class of antennas is referred to as fast wave antenna or more generally, a leaky-wave antenna since continuously lose energy due to radiation, and the second type of antenna is the surface wave antenna.

Leaky wave antennas are classified as fast wave antennas, their fields generally decaying along such a structure in the direction of propagation. Surface wave antennas do not generally render continuous radiation therefrom, but instead the surface wave that is formed along the interface between two different media is more or less bound to the surface and radiation takes place only at curvatures, nonuniformities, and discontinuities therefrom. Put otherwise, surface wave antennas radiate power flow from such discontinuities and nonuniformities in the antenna structure that interrupt a bound wave on the antenna surface. In such antennas the phase velocity is less than that of the surrounding medium and the E and H fields decay exponentially away from the source. In a sense, surface wave antennas may be simply viewed as trapped wave structures.

The term endfire source as used herein refers to a source of linear extent for which maximum radiation is along the linear axis and has generally a phase velocity less than the velocity of light in free space. The term broadside source as used herein refers to one in which maximum radiation is normal to the source, which is usually a line or a planar aperture. Generally, a broadside source is characterized by an infinite phase velocity through one aperture.

The subject antenna may be viewed as a slow wave structure in which radiation takes place only at either discrete or distributed discontinuities, nonuniformities and curvatures in the antenna structure. In the subject invention it will be seen that, for example, there is a discontinuity along the surface as well as the in the form of transmission line termination into the electromagnetic window or lens material. The subject antenna can be readily used as an endfire or near-endfire radiating device. In general, the subject antenna exhibits a 3:1 bandwidth. The specific features and arrays formed by the recited combination of features, to be further discussed in more detail hereinafter, produce and characterize the advantages of the subject invention.

The subject invention allows the formation of a field radiation pattern that is projected directly outwardly in an endfire fashion as compared to conventional conformal designs that project their field patterns normal to their length. In the subject invention, an endfire pattern is produced forward or in the aft direction so that, in a number of applications, the actual antenna structure may be mounted in a less controlled location, that is, one in which there are less active devices, components, sensors, mechanical devices and the like that often tend to be required to be placed forward or at the leading edge or edges. From a design engineering point of view, a less controlled area is highly desirable.

The subject invention lends itself in avoiding many of the so-called thermal spots associated with fast moving objects. In aircraft, for example, the leading edges are often exposed to exceedingly high temperatures and pressures. In following the teachings of the subject invention, one skilled in the art may readily employ the subject antenna structure or array thereof in a less benign environment such as in the fuselage or wing, well rearward of leading edges. In such locations, the subject invention would exhibit excellent performance characteristics, such as wide scan capability.

Although single element antenna structures have been disclosed, it will be recognized by those skilled in the art that a number of desirable radiation patterns may not be readily achievable by single elements and that an array or aggregate of such structures in an electrical and geometrical arrangement must be formed to produce a desired radiation characteristics. Such arrangements may be linear, curved and the like, for example, and may be designed in a substantially flat plane or in three-dimensional configurations as more fully disclosed hereinafter.

BRIEF DESCRIPTION OF THE DRAWINGS

It will be appreciated that further objects and attending advantages thereof will be apparent under study and consideration of the following description, especially when taken in conjunction with the accompanying drawings in which.

DESCRIPTION OF THE PREFERRED EMBODIMENT

Figure 1A:
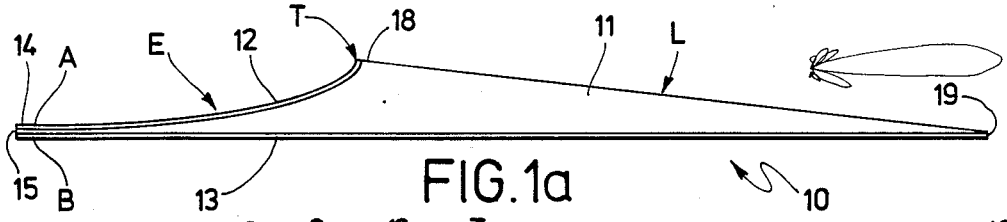
FIG. 1*a* illustrates an elevational view of the subject antenna constructed in accordance with the instant invention.
Figure 1B:
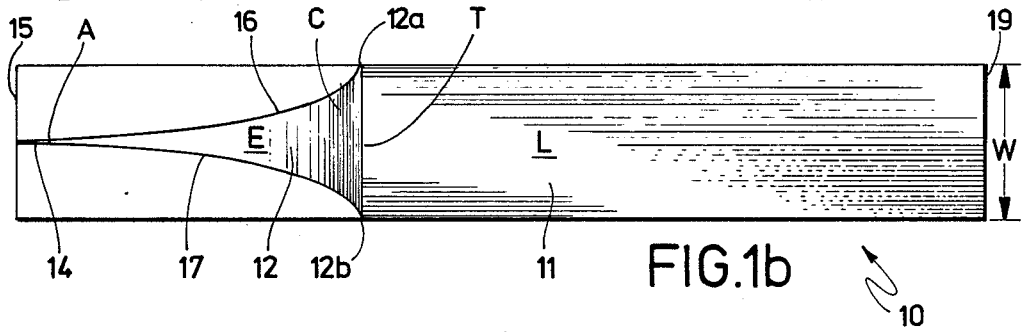
FIG. 1*b* illustrates a plan view of the subject antenna of FIG. 1*a;*

A broadband antenna device of the present invention is illustrated schematically in FIGS. 1*a* and 1*b* that depict an antenna element 10 that includes a substrate 11 having a topside metallization 12 and a bottomside metallization 13, both metallizations of, for example, copper. At one end of the topside metallization 12 is a microstrip transmission line 14 integrally formed with the metallization 12 and making up a small extension thereof. As seen, the metallization 12 is coupled to a narrow strip comprising the microstrip transmission line 14 near an end 15 of the substrate 11 and forms a gradual transition into a broad strip expanding to positions 12*a* and 12*b*, the width (w) of the substrate 11, the metallization 12 itself extending only a portion of the length of the antenna element 10. It can be seen that edges 16 and 17 of topside metallization 12 are formed in such a fashion as to present a smooth and continuous transition from the microstrip transmission line 14 to thereby provide a symmetrical flared structure E that takes on the appearance of trumpet-like configuration. The bottomside metallization 13 extends from end 15 as a metallization covering the entire bottom surface of the substrate 11 and functions as a ground plane for the antenna element 10.

It can be seen that the microstrip transmission line 14 comprises in its simplest form two conductors, one being essentially a line conductor A and the other a ground conductor B, spaced close together in substantially parallel relation. In general, the ground conductor B may be at ground potential or some other given potential and is considerably wider than the line conductor A so that the surface thereof provides in effect an image reflection of the line conductor A, whereby the distribution of the electric and magnetic fields between the conductors is substantially the same as the distribution between one conductor and the neutral plane of a theoretically perfect two-conductor parallel system. Small variations in size and shape of the line conductor A may produce variations in the characteristic impedance of the system but the field distribution with respect to the ground conductor B is not materially disturbed. Likewise, certain variations in the surface of the ground conductor B do not materially disturb the field distribution with respect to the surface thereof since such variations either neutralize each other or do not adversely affect the field distribution between the two conductors. Preferably, the ground conductor B should be from two to three times the width of the line conductor A, although wider dimensions may be used as they give still lower loss. In such a system, electromagnetic waves can be easily propagated by a mode closely simulating the TEM mode along the line-ground conductor system.

The substrate 11 is tapered in thickness toward the end 15 so that the metallization 12 terminates in line 14 near the bottom metallization but spaced therefrom at the end 15. It can be seen that substrate 11 slopes downwardly from an upper edge 18 to end 15 as well as to a termination 19. This downward slope or taper from upper edge 18 to end 19 is important in creating the slow wave antenna of the subject invention in that the diminishing cross-sectional area from along the taper is responsible for the phase velocity of the surface wave in a broad bandwidth.

The cross-sectional dimensions of the antenna structure comprises a base and sides that meet at the upper edges. As best seen in FIG. 1*a*, the sides are different, in this embodiment, in that the slope L between upper edge 18 and termination 19 is substantially linear, whereas the slope between upper edge 18 and end 15 is substantially parabolic.

The substrate or lens material 11 has a selected shape taking the form of an exponential taper or straight wedge with the thicker end of the material being coupled to the metallization 12 and 13 or conductive legs and the thinner tapered end along slope L serving to function as a launching surface. With the diminishing thickness along the length of slope L from the thicker end 18 to the thinner end 19, a surface wave that is excited at the thicker end travels along the length of the substrate or lens material 11 with a phase velocity less than that of light.

An important aspect of the subject invention is the transitional geometry from the microstrip line 14 to the termination T of the flared line structure E. Another important feature of the subject invention is the immediate truncation of the lens material at or substantially coextensive with the termination of the planar transition along the upper edge of the lens material. It can be clearly seen that the line conductor A increase from the microstrip line 14 in surface area in a gradual and uniform fashion toward the upper end 18 so that the line conductor A defines structure E, a curved, planer flared element that tapers upwardly away from the ground line 13. Thus, the metallization 12 gradually slopes upwardly, increasing in area and in distance from the ground or bottom metallization 13 and terminates at the upper end 18 in a straight line fashion as best shown in FIG. 1*b*. It should be further appreciated that the two metallizations are no longer parallel along the length of element 10 as essentially was the case as regards the short extent of microstrip line 14, but are in divergence and, therefore, the TEM mode that was established along microstrip line 14 would now be modified by that geometry.

From a broad aspect of the instant invention, the device may be viewed as an embedded antenna device comprising two spaced apart planar members or metallizations 12 and 13, one member or metallization 12 being a conductive transition from a narrow portion to a wider portion according to a continuous function, said one member or metallization 12 having an upward inclination away from the other of said members or metallizations 13 and ending in a termination T along or proximate the upper edge 18 of a substrate or tapered lens material 11, said lens material 11 having a downward inclination from said termination T or upper edge 18 toward the other of said members or metallizations 13 to define a sloping surface L between edge 18 and the end of said lens material 19 for launching and receiving electromagnetic waves.

Although not shown, a number of connecting means, for example, a coaxial to microstrip transition, may be readily used for coupling energy to and from the subject antenna structure as can be appreciated by those skilled in the art.

Although the termination T in FIG. 1*b* is shown linear or following a straight line, it is understood that the termination may be so configured or shaped at the terminating edge such as to be curved or serrated. A serrated terminating edge T′ is illustrated in FIG. 2*c*. In the latter case, the degree of serration may be varied depending on frequency considerations. These configurations are useful features when low observable characteristics are sought. As can be appreciated, these structural features are especially utilized to substantially reduce radar cross-sections.

The single element of FIGS. 1*a* and 1*b* may be readily adapted into an assembly of radiating elements in an electrical and geometric configuration to provide an array of elements rendering a radiation pattern that vectorially add up to a given maximum field intensity in a particular direction or directions and cancels or substantially cancels in others.

Figure 2A:
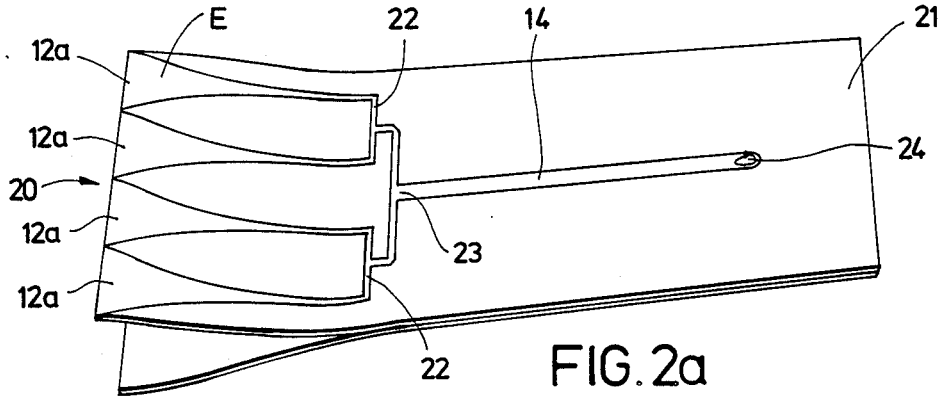
FIG. 2*a* illustrates a perspective view of an embodiment of the subject invention.
Figure 2B:
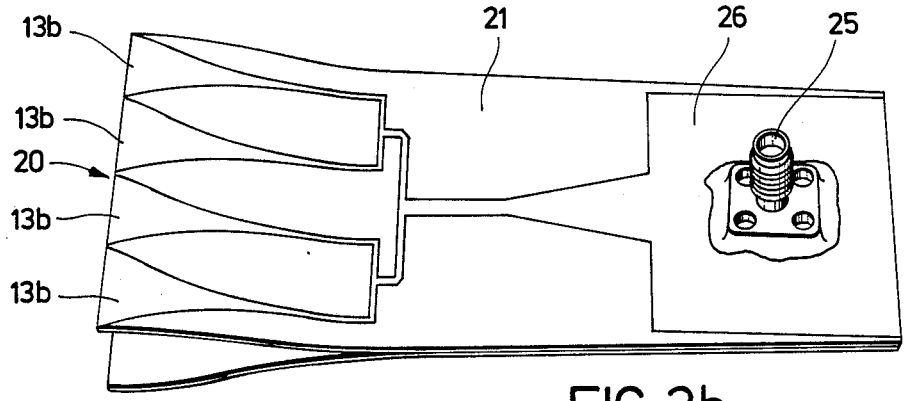
FIG. 2*b* illustrates a perspective view of the back side of embodiment depicted in FIG. 2*a;*
Figure 2C:
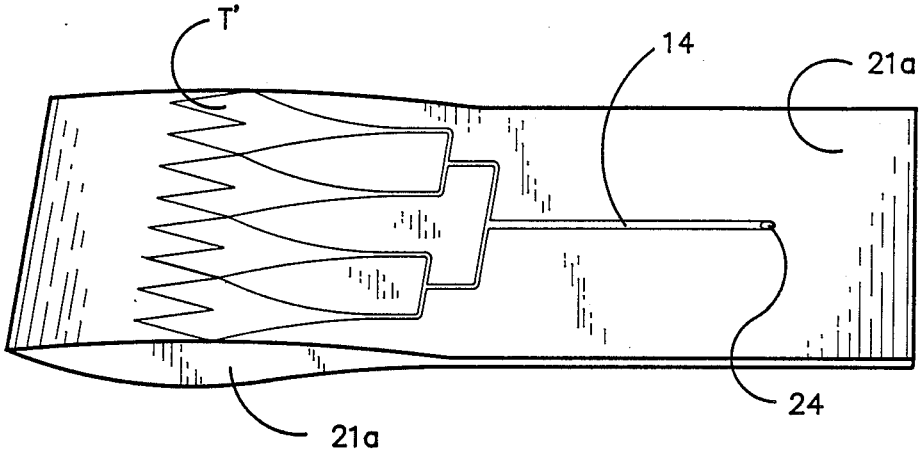
FIG. 2*c* illustrates an embodiment of the invention having a serrated termination.

FIGS. 2*a* and 2*b* show an array 20 of antenna elements 10 comprising four broadband elements 12*a* and 13*b*. The array 20 is supported on a substrate layer 21 which has a plurality of thin ribbon-like conductive leads 22 including T-shaped leads 23 (three each of which are shown both in FIGS. 2*a* and 2*b*) that connect to the microstrip transmission line 14 of the respective elements 10 at one end and are joined by a signal feed function designated by reference numbered 24 at the other end. Leads 22 are suitably dimensioned (length, width and thickness) so as to provide continuous impedance matching between a coaxial transmission line 25. With the impedance of coaxial transmission line 25 being appropriately chosen so as to match the impedance of between a source (not shown) and the array which, of course, provides for a more efficient antenna. In addition, the distances between the coaxial line input and each feed point are equal. In this manner, combination multiple feed and impedance matching network separates the input signal from coaxial transmission line into a plurality of equal phase and amplitude signals and transfers the same to feed points for exciting the array in the most favorable manner. It should be noted in this embodiment that the metallizations or elements 12*a* and 13*b* are mirror images of each other, that is, the ground conductor 26 does not occupy the entire surface as was the case in the embodiment depicted in FIG. 1*a* and 1*b*. It will be appreciated by those skilled in the art that phase and/or amplitude controls may also be implemented to achieve steered radiation patterns and/or low side lobes.

While the array shown in FIGS. 2*a* and 2*b* include only four pairs of radiating elements, it is to be understood that the invention, as contemplated, is by no means limited thereto in that there may be any number of radiating elements that can be arranged in different patterns. Further, there may be any number of feed points and paths associated therewith. Accordingly, the paths between the input and feed points may take on various dimensions and designs so long as the aforedescribed impedance matching and input signal separation functions are generally preserved. In this regard, the latter function is assured if the paths are of equal distances.

It should be appreciated that the array shown in FIGS. 2*a* and 2*b* may readily receive a tapered lens material by simply coupling the same into the spaced-apart elements 12*a* and 13*b* in such a fashion that the tapering face of said lens material extends in the forward position, outward from the array. Such an array having tapered lens material or substrate 21*a* is illustrated in FIG. 2*c*.

The conductive legs or planar members of the subject antenna structure may be fed by a coaxial line directly into the microstrip line and, so when fed with r.f. energy, creates a near field across the discontinuity thereby establishing the propagation of far field radiation. It will be appreciated that the polarization of the structure launches linearly therefrom with the E-vector component lying in the plane of the dielectric substrate and the H-vector component being at right angle thereto.

It will be appreciated that the novel antenna structure herein disclosed may be readily configured into an orthogonally polarized array as already shown. As is known the radiation pattern of an array depends upon the relative positions of the individual elements, the relative phases of the currents or fields in the individual elements, the relative magnitudes of the individual element currents or fields and the patterns of the individual elements. The radiated field from the array at a given point in space is the vector sum of the radiated fields from the individual elements.

Figure 3:
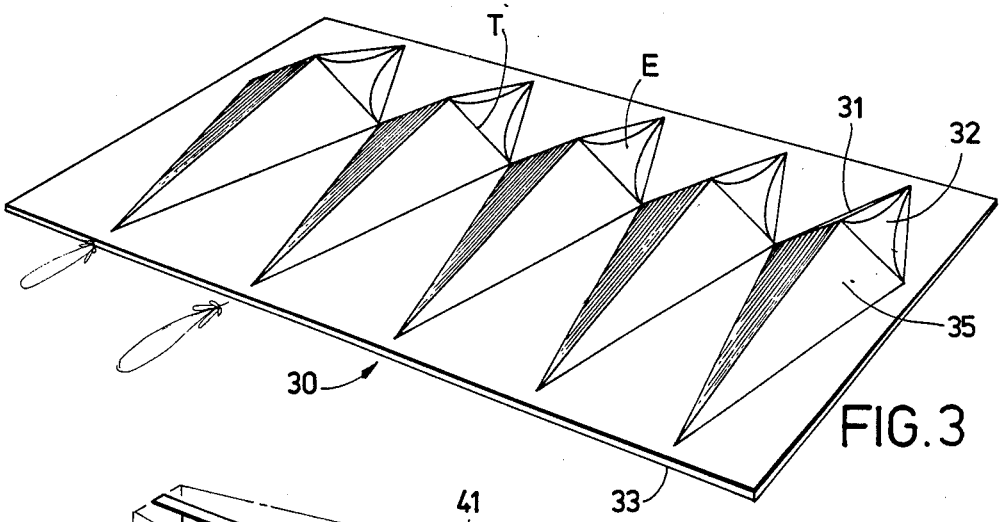
FIG. 3 illustrates yet another perspective of an embodiment of the subject invention in an array configuration depicting a dual polarized arrangement thereof.
Figure 4:
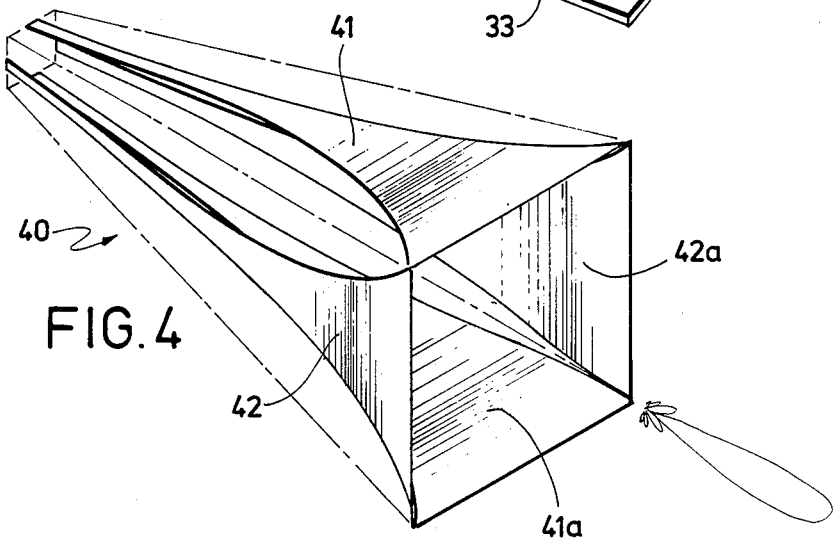
FIG. 4 illustrates another embodiment of the subject invention.
Figure 5:
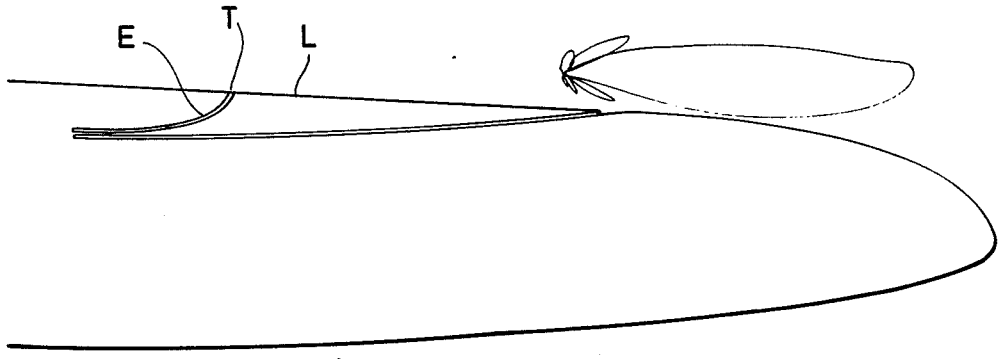
FIG. 5 illustrates a plan view of an airplane wing showing the subject antenna located thereon.
Figure 7:
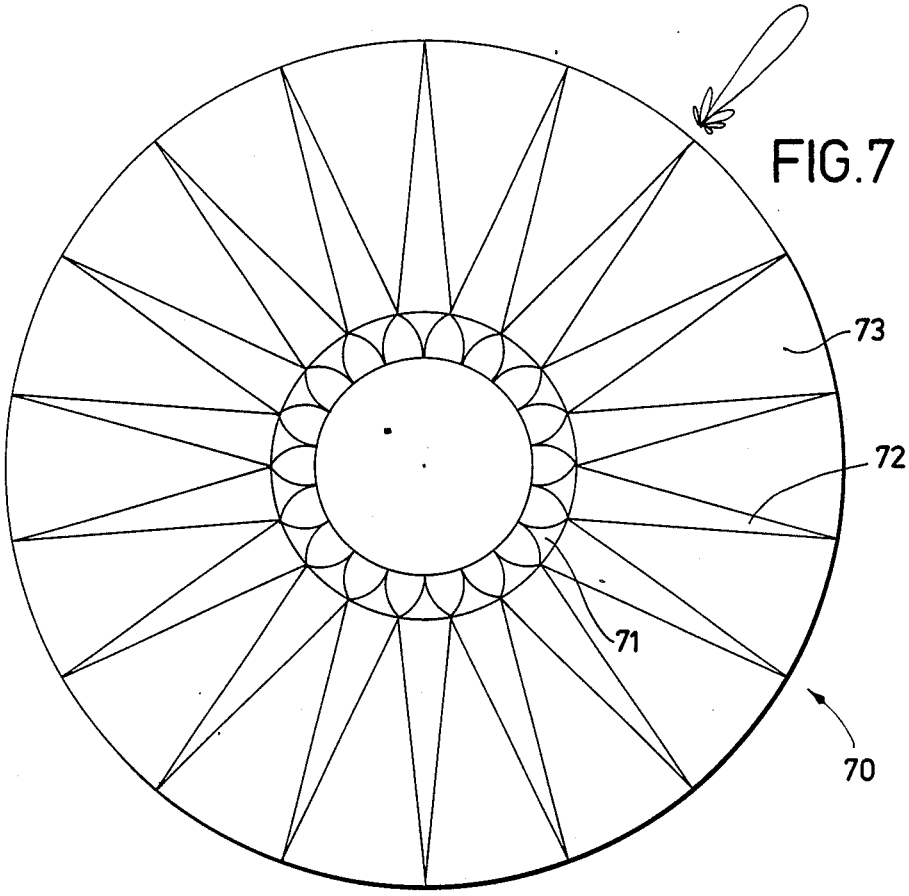
FIG. 7 depicts yet another embodiment of the subject invention in which an array of elements are arranged in a circular configuration.
Figure 6B:
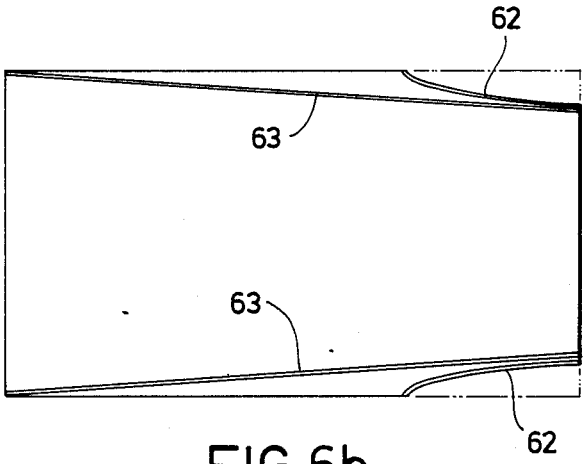
FIG. 6*b* illustrates an end view of FIG. 6*a;*
Figure 6A:
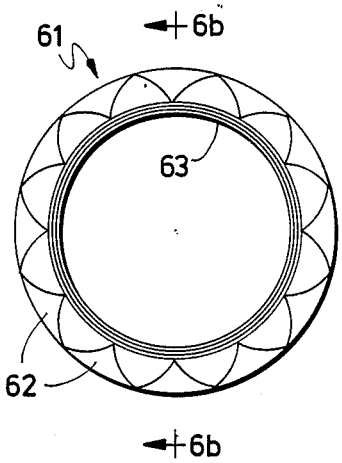
FIG. 6*a* illustrates an elevational view of the subject invention as arranged on a cylindrical object.

FIG. 3 depicts an array embodiment 30 in which five elements are situated in alignment with one another, each element comprising a combination of two trumpet-like configurations, 31 and 32, above a ground plane 33. The lens material or substrate 35 takes on a triangular raised configuration and each combination of elements launches a radiation pattern as dramatized. FIG. 4 represents yet another array embodiment 40 shaped in a square or box-like pattern wherein each element, 41 and 42, has a mirror image in the form of element 41*a* and 42*a* that act as respective ground planes. Although not shown, the lens material would be coupled forward of the array and have tapering surfaces converging to the central line passing along the longitudinal axis of the array. FIG. 5 shows an embodiment in the wing section of an airplane with a dramatized version of the associated radiation pattern. FIG. 6*a* and 6*b* show still one other embodiment in which the subject antenna element 61 may be used in an array about a cylindrical body in which the radiating elements 62 are symmetrically situated around a common ground plane 63. FIG. 7 depicts still another embodiment in which elements 71 are arranged in a circular array and provide a full 360 degree radiation coverage. The substrate 72 provides gently sloping surfaces 73 from the elements 71 and represent a substantially conformal array in accordance with the subject invention. It follows from consideration of the aforementioned embodiments that simple switched beam arrays as well as phased arrays may be readily formed by utilizing the novel antenna devices in combination with conventional electronic components.

Figure 8:
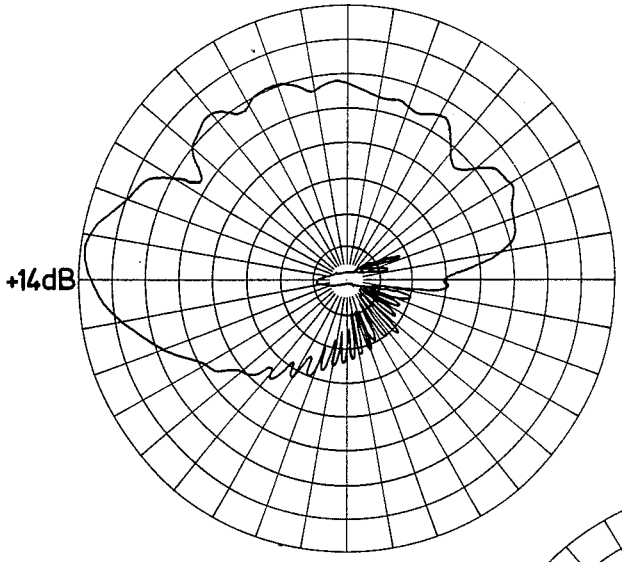
FIG. 8 depicts a radiation field pattern of the subject antenna element at low frequency, 4 GHz., the pattern being one in broadside elevation.
Figure 9:
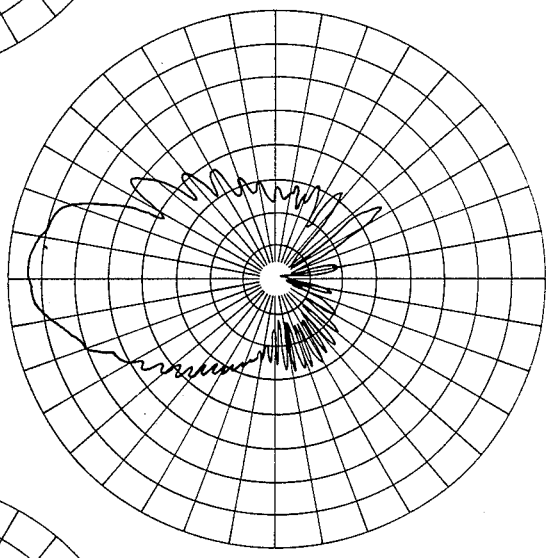
FIG. 9 depicts yet another radiation field pattern of the subject antenna element at an intermediate frequency 8 GHz., the pattern being one in broadside elevation.
Figure 10:
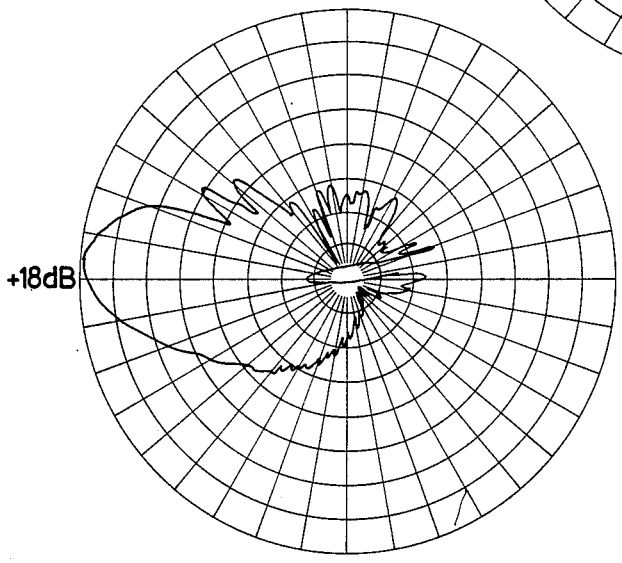
FIG. 10 depicts a radiation field pattern of the subject antenna element at a high frequency, 12 GHz; the pattern being one in broadside elevation.

FIG. 8 depicts a radiation field pattern of the subject antenna element at low frequency, 4 GHz; the pattern being one in broadside elevation; FIG. 9 depicts still another radiation field pattern at an intermediate frequency, 8 GHz; the pattern being one in broadside elevation; and FIG. 10 depicts a radiation field pattern at still a higher frequency, 12 GHz; the pattern being one in broadside elevation.

A wide range of lens materials may be used in accordance with the subject invention and include dielectric materials, lossy materials, as well as ferrites. Thus, various ceramic and glasses may be used, as well as plastics, including alkyd resins, polyethylene, polystyrene, and the like. A wide range of ferrites may be employed as substrates, as well as ceramic ferrites and the like. Further, a host of lossy or insulating materials may also be readily used which dissipate more than usual energy or have relatively high attenuations.

Although a number of advantageous embodiments as well as preferred embodiments have been specifically illustrated and described herein, it is understood that minor modifications may be made in the antenna construction without departing from the spirit and scope of the invention as defined by the appended claims.

We claim:

1. A broadband antenna device comprising two spaced apart conductive planar members, one member being a transition from a narrow portion to a wider portion according to a continuous function, said one member having an upward inclination away from the other of said conductive planar members and ending in a termination at the wider portion, a tapered lens material having a downward inclination from said termination toward said other of said conductive planar members to define a sloping surface therebetween for launching and receiving electromagnetic waves.

2. A broadband antenna as recited in claim 1 wherein the one member being a transition comprises a microstrip transmission line and a flared metallization integrally coupled therewith.

3. A broadband antenna as recited in claim 2 wherein the flared metallization is triangular.

4. A broadband antenna as recited in claim 2 wherein the flared metallization is trumpet-shaped.

5. A broadband antenna as recited in claim 2 wherein the microstrip transmission line supports a TEM mode.

6. A broadband antenna as recited in claim 1 wherein the other of said conductive planar members extends substantially past said termination of said one member being a transition.

7. A broadband antenna as recited in claim 1 wherein the termination of the one member being a transition is linear.

8. A broadband antenna as recited in claim 1 wherein the termination of the one member being a transition is serrated.

9. A broadband antenna as recited in claim 1 wherein the tapered lens material has a dielectric constant of 1 or greater and said tapered lens material decreases in thickness in the forward direction from the termination.

10. A broadband antenna array comprising a plurality of broadband antenna devices as recited in claim 1 arranged to form a predetermined radiation field pattern.

11. An array as recited in claim 10 wherein the devices are linearly configured.

12. An array as recited in claim 10 wherein the devices are curvilinearly configured.

13. An array as recited in claim 12 wherein the devices are disposed in a cylindrical array.

14. An array as recited in claim 12 wherein the devices are arranged in a planar array, for launching and receiving a collimated beam.

15. A broadband antenna device comprising two spaced apart conductive planar members, one member being a transition from a narrow portion to a wider portion according to a continuous function, said one member having an upward inclination away from the other of said conductive planar members and ending in a termination at the wider portion, a tapered lens material having a downward inclination from said termination toward said other of said conductive planar members to define a sloping surface therebetween for launching and receiving electromagnetic waves, said tapered lens material being a material selected from the group consisting of dielectric material, lossy material and a ferrite.

16. A broadband antenna as recited in claim 15 wherein the one member being a transition comprises a microstrip transmission line and a flared metallization integrally coupled therewith.

17. A broadband antenna as recited in claim 15 wherein the flared metallization is trumpet-like.

18. A broadband antenna as recited in claim 15 wherein the microstrip transmission line supports a TEM mode.

19. A broadband antenna as recited in claim 15 wherein the other of said conductive planar members extends substantially beyond said termination of said one member being a transition.

20. A broadband antenna as recited in claim 15 wherein the termination of the one member being a transition is linear.

21. A broadband antenna as recited in claim 15 wherein the termination of the one member being a transition is curved.

22. A broadband antenna as recited in claim 15 wherein the termination is serrated.

23. A broadband antenna as recited in claim 15 wherein the other of said conductive planar members covers an entire surface of said tapered lens material.

24. A broadband antenna as recited in claim 15 wherein the other of said conductive planar members cover less than an entire surface of said tapered lens material.

25. A broadband antenna as recited in claim 20 wherein the flared transition has a narrow portion to a wide portion according to an exponential function.

26. A broadband antenna as recited in claim 21 wherein the flared transition has a narrow portion to a wide portion according to a continuous function.

27. A broadband antenna comprising a radiator including a ground plane and a ribbon having a flared transition from a narrow portion spaced above the ground plane to a wider portion spaced a greater distance from the ground plane, a lens member having a tapered configuration joined to said radiator, said lens member having a sloping surface inclined downwardly from the flared transition to said ground plane.

28. A broadband antenna as recited in claim 27 wherein the flared transition comprises a microstrip transmission line and a trumpet-shaped metallization integrally coupled therewith.

29. A broadband antenna as recited in claim 28 wherein the ground plane extends substantially past an end of said flared transition having the wider portion.

30. A broadband antenna as recited in claim 27 wherein the lens member is selected from the group consisting of dielectric material, lossy material and a ferrite.

31. A broadband antenna array comprising a plurality of broadband antennas as recited in claim 27 arranged to form a predetermined radiation field pattern.

32. An array as recited in claim 29 wherein the elements are linearly configured.

33. An array as recited in claim 29 wherein the elements are curvilinearly configured.

34. An array as recited in claim 33 wherein the elements are formed in a cylindrical array.

35. An array as recited in claim 33 wherein the elements are arranged in a planar array for launching and receiving a collimated beam.

36. An antenna structure for receiving and transmitting electromagnetic waves comprising a conductive means comprising first and second spaced-apart planar legs, the first conductive leg having a transition from a narrow portion to a wide portion according to a function, said first and second conductive legs spreading outwardly from respective first terminations and ending into respective second terminations, and an electromagnetic lens material coupled to and filling the space between said first and second conductive legs, said material having a maximum thickness at the second terminations and a thinner thickness at the first terminations.

37. An antenna structure as recited in claim 36 in which the lens material is a lossy dielectric material.

38. An antenna structure as recited in claim 36 in which the lens material is a ferrite material.

39. An antenna structure as recited in claim 36 in which the two planar legs are substantially identical in configuration.

40. An antenna structure as recited in claim 36 in which the transition follows a continuous linear function.

41. An antenna structure as recited in claim 36 in which the transition follows a parabolic function.

42. An antenna structure as recited in claim 36 in which the electromagnetic lens material decreases in thickness past the second terminations.

43. An antenna structure as recited in claim 42 in which the decreasing thickness defines a sloping surface for launching surface waves therefrom.

44. An antenna structure as recited in claim 36 in which the transition is trumpet-like.

45. An antenna structure as recited in claim 36 in which the second terminations are straight.

46. An antenna structure as recited in claim 36 in which the second terminations are serrated.

47. A broadband antenna array comprising a plurality of broadband antenna structures as recited in claim 36 arranged to form a predetermined radiation field pattern.

48. A broadband antenna array as recited in claim 47 wherein the structures are linearly configured.

49. A broadband antenna array as recited in claim 47 wherein the structures are curvilinearly configured.

50. A broadband antenna array as recited in claim 49 wherein the structures are formed in a cylindrical array.

51. A broadband antenna array as recited in claim 49 wherein the structures are arranged in a planar array for launching and receiving a collimated beam.

* * * * *